US008701546B2

(12) United States Patent
Pacht

(10) Patent No.: US 8,701,546 B2
(45) **Date of Patent: *Apr. 22, 2014**

(54) COUPLING ARRANGEMENT PROVIDING AN AXIAL SPACE BETWEEN A PLUNGER AND PLUNGER ADAPTOR OF A HIGH PRESSURE FLUID PUMP

(75) Inventor: Amos Pacht, Houston, TX (US)

(73) Assignee: Gardner Denver Water Jetting Systems, Inc., Houston, TX (US)

( * ) Notice: Subject to any disclaimer, the term of this patent is extended or adjusted under 35 U.S.C. 154(b) by 1037 days.

This patent is subject to a terminal disclaimer.

(21) Appl. No.: 12/710,919

(22) Filed: Feb. 23, 2010

(65) Prior Publication Data

US 2011/0138997 A1 Jun. 16, 2011

Related U.S. Application Data

(63) Continuation-in-part of application No. 12/638,050, filed on Dec. 15, 2009, now Pat. No. 8,528,462.

(51) Int. Cl.
*F01B 29/00* (2006.01)
*F01B 1/00* (2006.01)

(52) U.S. Cl.
USPC ..... 92/128; 92/147

(58) Field of Classification Search
USPC ..... 92/128, 129, 146, 147, 161; 29/888.029; 403/310, 335, 338
See application file for complete search history.

(56) References Cited

U.S. PATENT DOCUMENTS

| | | | | |
|---|---|---|---|---|
| 1,902,038 | A | 3/1933 | McAllister | |
| 4,160,626 | A | 7/1979 | Bell | |
| 4,277,229 | A | 7/1981 | Pacht | |
| 5,302,087 | A | 4/1994 | Pacht | |
| 5,507,219 | A | 4/1996 | Stogner | |
| 6,113,304 | A | 9/2000 | Termoulet, Jr. et al. | |
| 6,241,492 | B1 | 6/2001 | Pacht | |
| 6,886,832 | B2 | 5/2005 | Forrest | |
| 7,121,812 | B2 | 10/2006 | Forrest | |
| 7,182,016 | B2 | 2/2007 | Forrest | |
| 8,528,462 | B2 * | 9/2013 | Pacht | 92/128 |
| 2002/0079383 | A1 | 6/2002 | Forrest | |
| 2004/0161351 | A1 | 8/2004 | Forrest | |
| 2004/0178285 | A1 | 9/2004 | Forrest | |

FOREIGN PATENT DOCUMENTS

| | | |
|---|---|---|
| JP | 11037058 | 2/1999 |

OTHER PUBLICATIONS

Limited Acknowledgement of Prior Art Regarding Figures 2-9 of U.S. Appl. No. 12/710,919.
The International Search Report and Written Opinion related to international application No. PCT/US2010/057614, mailed Jan. 27, 2011.
The International Preliminary Report on Patentability related to international application No. PCT/US2010/057614, mailed Mar. 5, 2012.
A computer translation of JP11037058 A, concurrently disclosed.
Dec. 6, 2012 Office Action for U.S. Appl. No. 12/638,050.
Further Limited Acknowledgement of Prior Art Regarding Figures 2-9 of U.S. Appl. No. 12/710,919.
Additional Limited Acknowledgement of Prior Art Regarding Figures 2-9 of U.S. Appl. No. 12/710,919.
Schematic portion of a pump Nov. 1996 (1 page).

* cited by examiner

*Primary Examiner* — Michael Leslie
(74) *Attorney, Agent, or Firm* — James B. Conte; Husch Blackwell LLP

(57) ABSTRACT

A coupling for a pump connects a plunger to a plunger adaptor. The coupling provides a space between an end of the plunger and an end of the adaptor. Upon disconnecting the plunger from the adaptor, the space provides for removal of the plunger from and through a well of the pump.

24 Claims, 16 Drawing Sheets

COUPLING ARRANGEMENT PROVIDING AN AXIAL SPACE BETWEEN A PLUNGER AND PLUNGER ADAPTOR OF A HIGH PRESSURE FLUID PUMP

The present application is a continuation-in-part of application Ser. No. 12/638,050, filed Dec. 15, 2009 now U.S. Pat. No. 8,528,462.

FIELD OF INVENTION

The present invention relates to a high pressure fluid pump having a coupling arrangement providing a space between a plunger end and a plunger adaptor end of the pump.

BACKGROUND

U.S. Pat. No. 5,302,087 discloses a high pressure pump. The pump has a plunger or pump piston linearly movable within a pump chamber during stroking of the pump. A suitable coupling is depicted for interconnecting the pump piston and drive housing output rod.

U.S. Pat. No. 4,277,229 discloses a high pressure fluid delivery system. The high pressure fluid system has a plunger with a threaded end for connection to a driving source which reciprocates the plunger along the longitudinal axis thereof.

Prior art FIG. 1 discloses a sectional view of a high pressure pump having an "L" or sectional design. FIG. 1 generally illustrates the components which form the pump. The pump has a fluid end assembly 10. The pump has a power end assembly 12. A frame 14 connects the fluid end assembly 10 to the power end assembly 12. The cross head 32 of the pump is positioned within the power end assembly in an orientation which would place the plunger 16 at the end of its suction stroke or beginning of its discharge stroke if the plunger 16 were assembled to the plunger adaptor 30.

FIG. 1 shows the fluid end assembly 10 partially disassembled to illustrate how one typically removes plunger 16 from the high pressure pump. Removal of the plunger 16 requires disassembly of suction manifold 18 from fluid cylinder block 20. Disassembly requires unscrewing bolts 22 to release suction manifold 18 from cylinder block 20. Additionally, removal of the plunger requires removal of suction valve assembly 24 from valve seat support 26 of fluid cylinder block 20. Once the suction manifold and valve assembly have been removed, one can remove plunger 16 by pulling plunger 16 axially away from the pump's power end 12*a* and fluid end 10*a*, thereby uncoupling an end 17 of a plunger 16 from coupling 28 of pony rod or plunger adaptor 30. The plunger is thus removed in the direction shown by arrow 31.

SUMMARY

Figure 1:
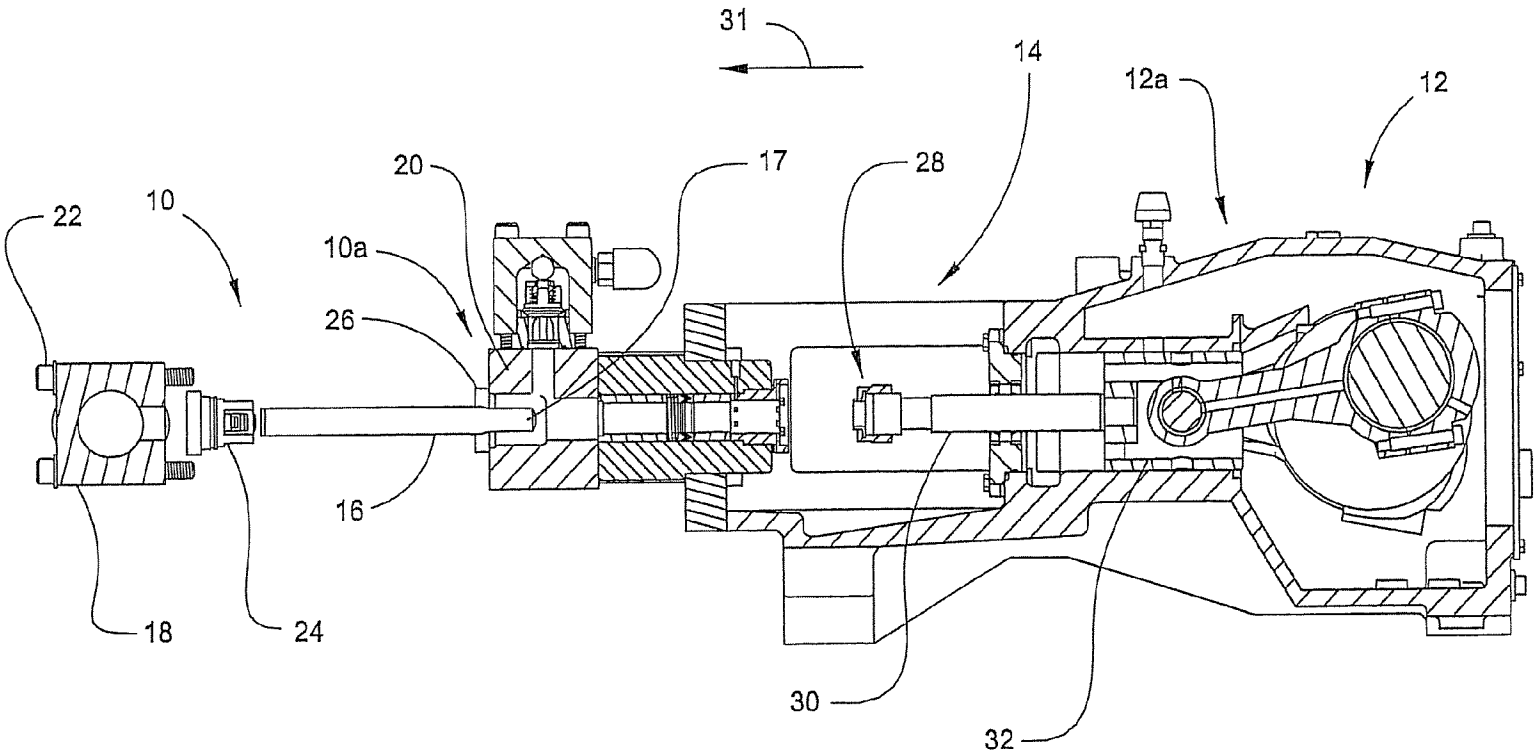
PRIOR ART Fig. 1
FIG. 1 is a prior art irregular sectional view of a high pressure pump partially disassembled.
Figure 2:
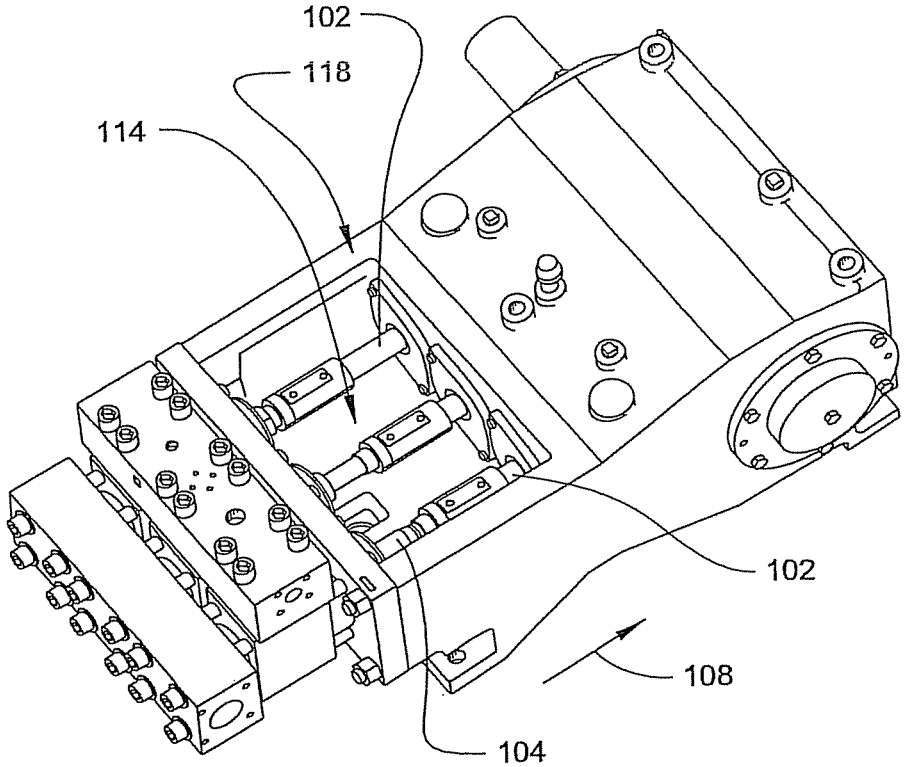
FIG. 2 is an isometric view looking from a fluid end assembly towards a power end assembly of a high pressure pump which embodies the features of the present invention.
Figure 3:
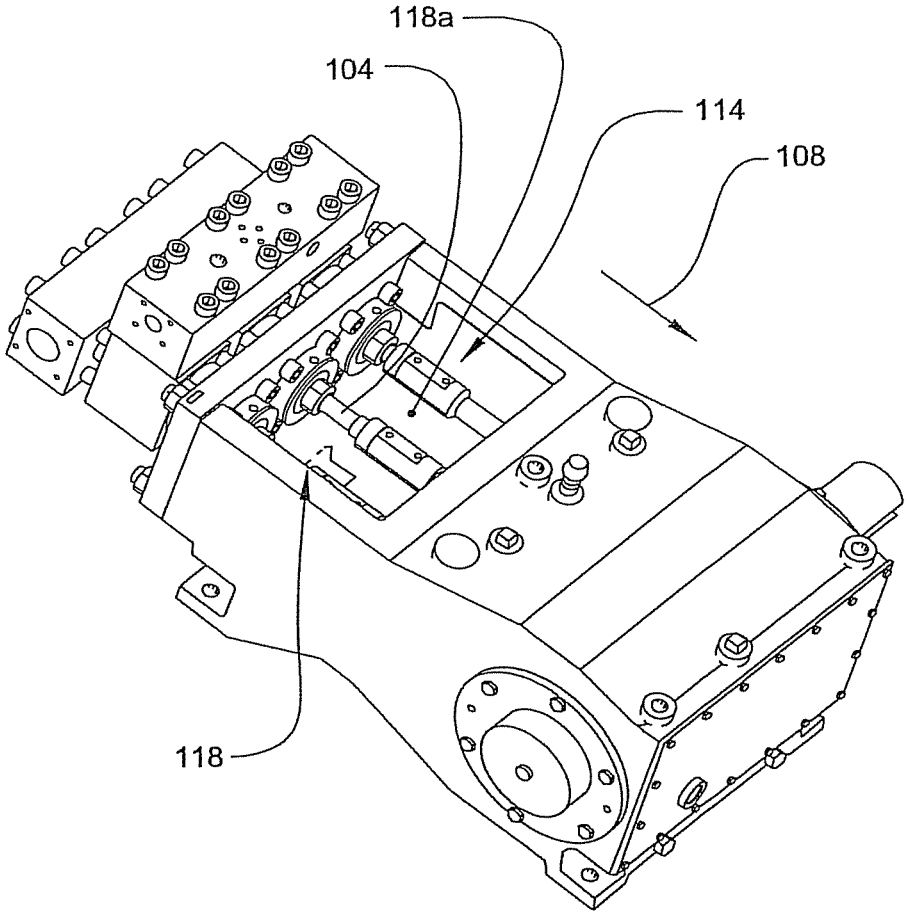
FIG. 3 is an isometric view looking from a power end assembly towards the fluid end assembly of the fluid pump shown in FIG. 2.
Figure 4:
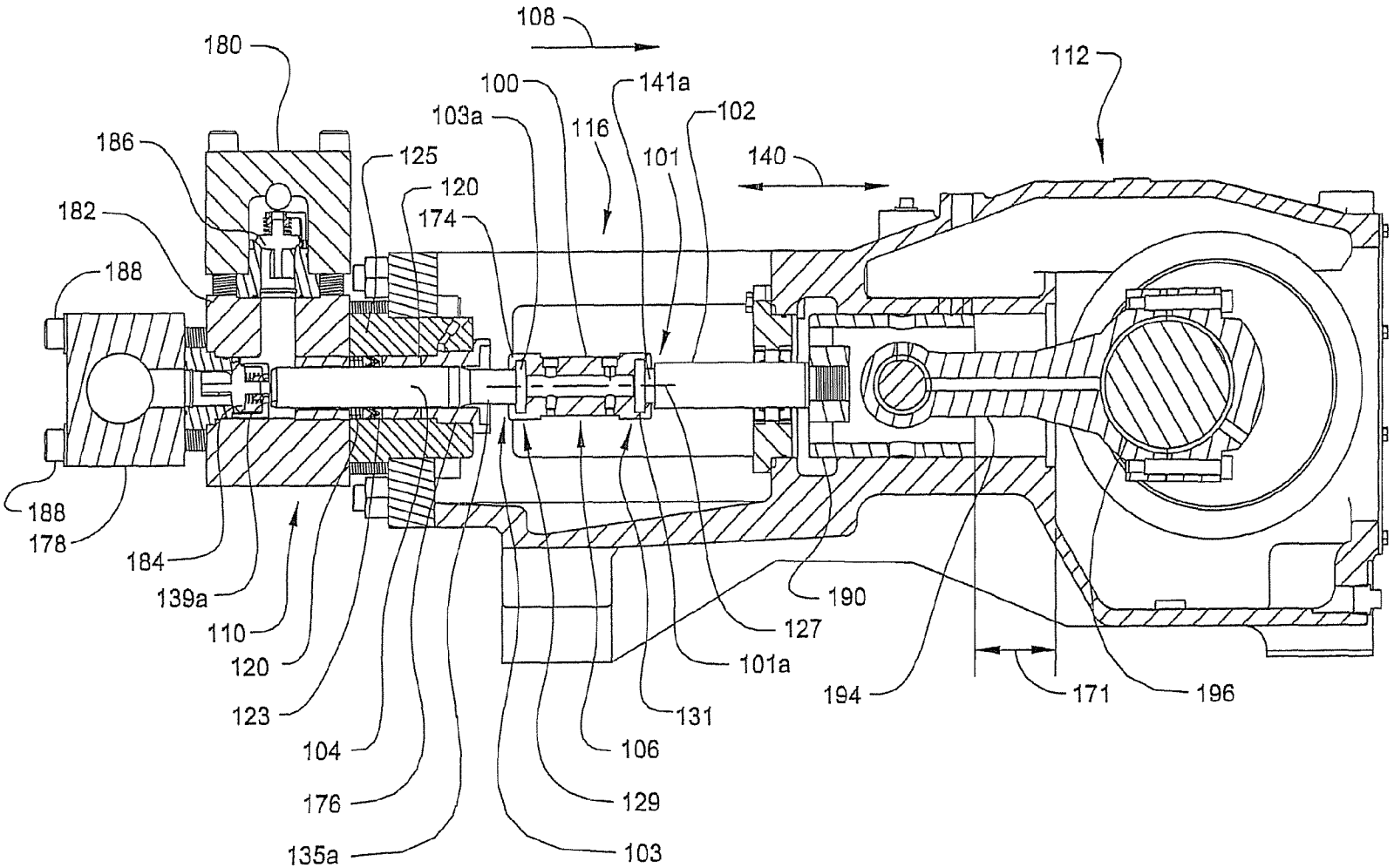
FIG. 4 is an irregular sectional view taken along a longitudinal length of the pump extending from the power end assembly to the fluid end assembly; the pump is at the end of its discharge stroke.
Figure 5:
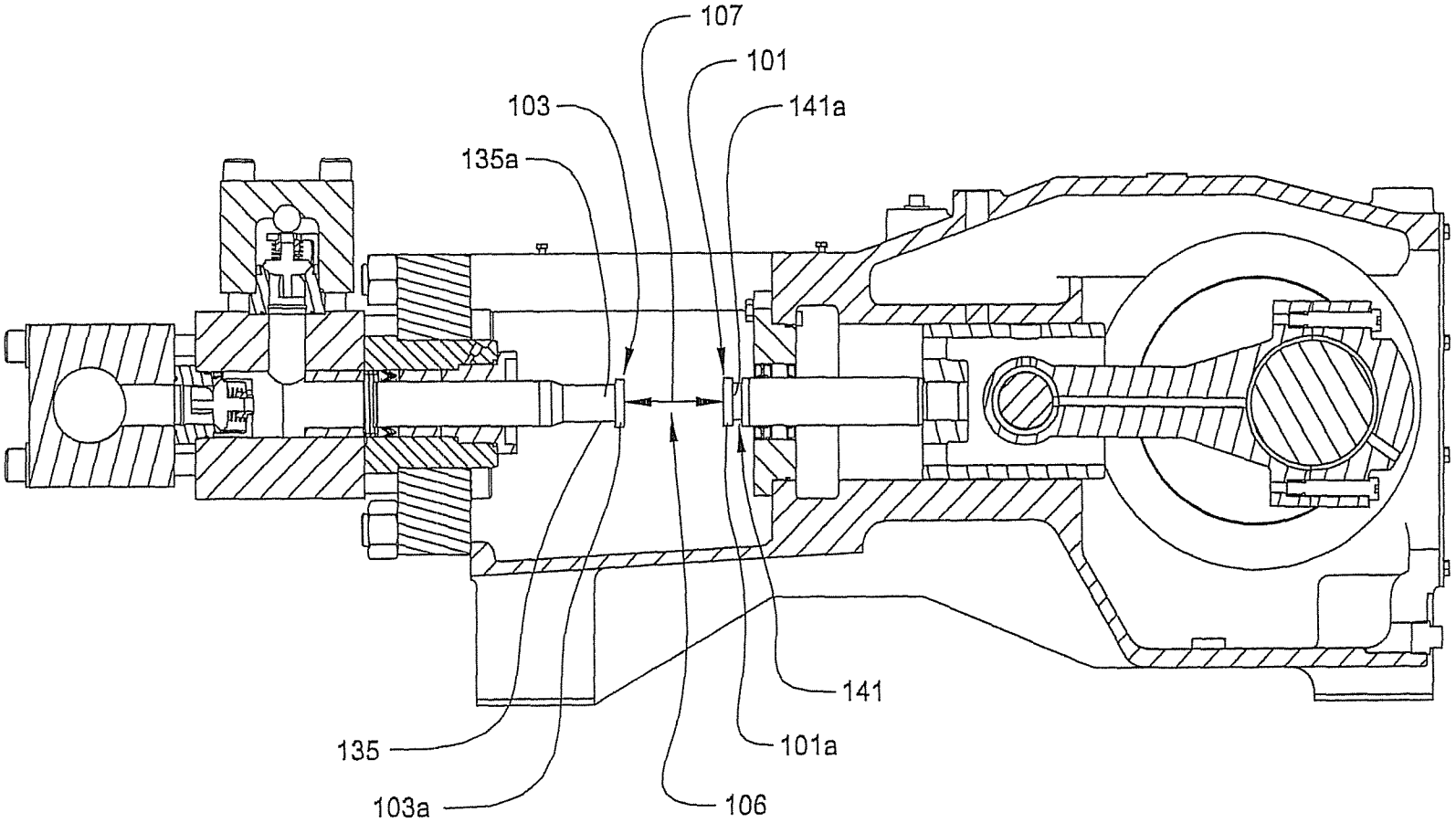
FIG. 5 is the sectional view shown in FIG. 4 except the pump is at the beginning of the discharge stroke and the coupling has been removed to allow for removal of the plunger from the well.
Figure 6:
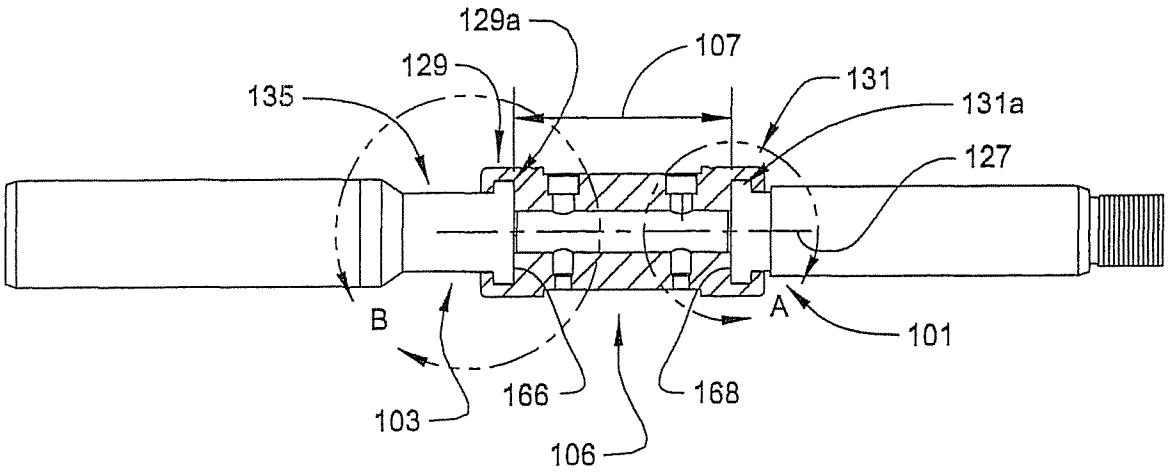
FIG. 6 is a close-up view of the plunger, plunger adaptor, and coupling shown in FIG. 3 removed from the pump; the coupling has been partially sectioned.
Figure 7B:
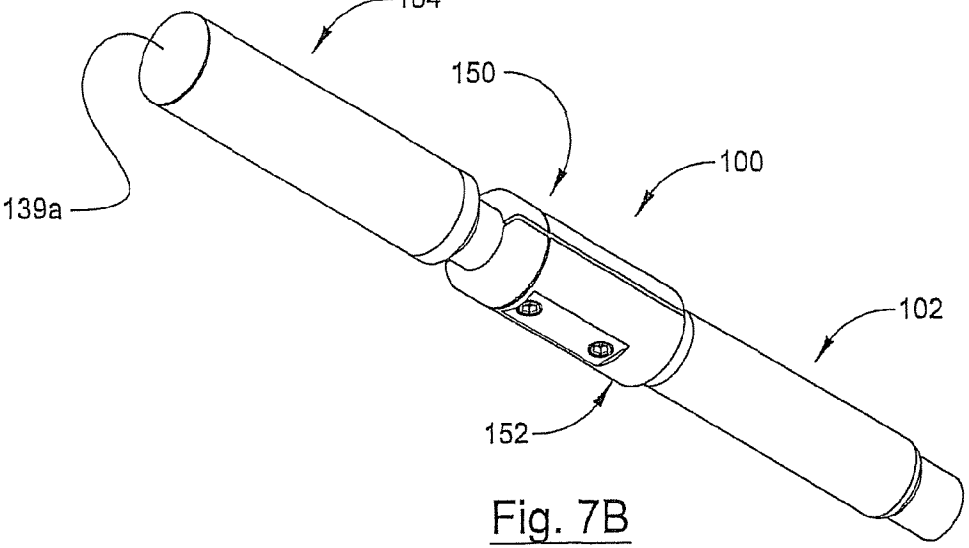
FIG. 7*b* is a perspective view of the assembly shown in FIG. 6.
Figure 7A:
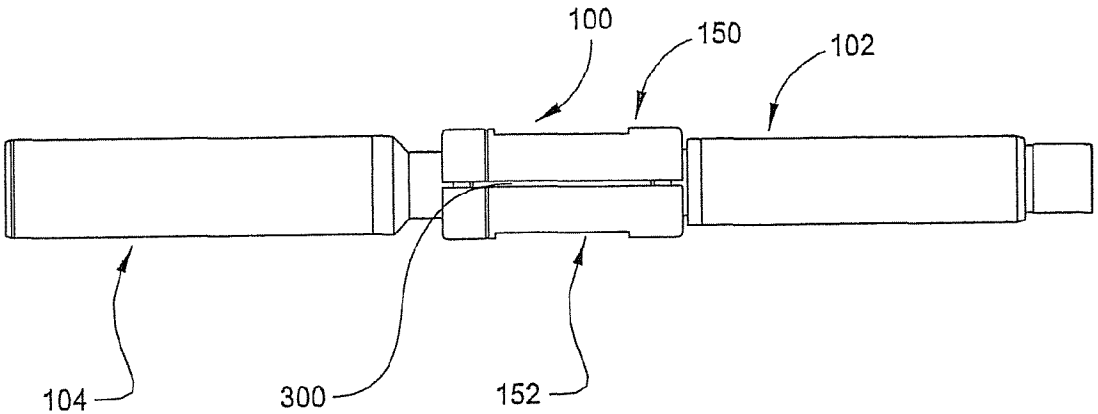
FIG. 7*a* is a view of the assembly shown in FIG. 6 without sectioning the coupling.
Figure 7C:
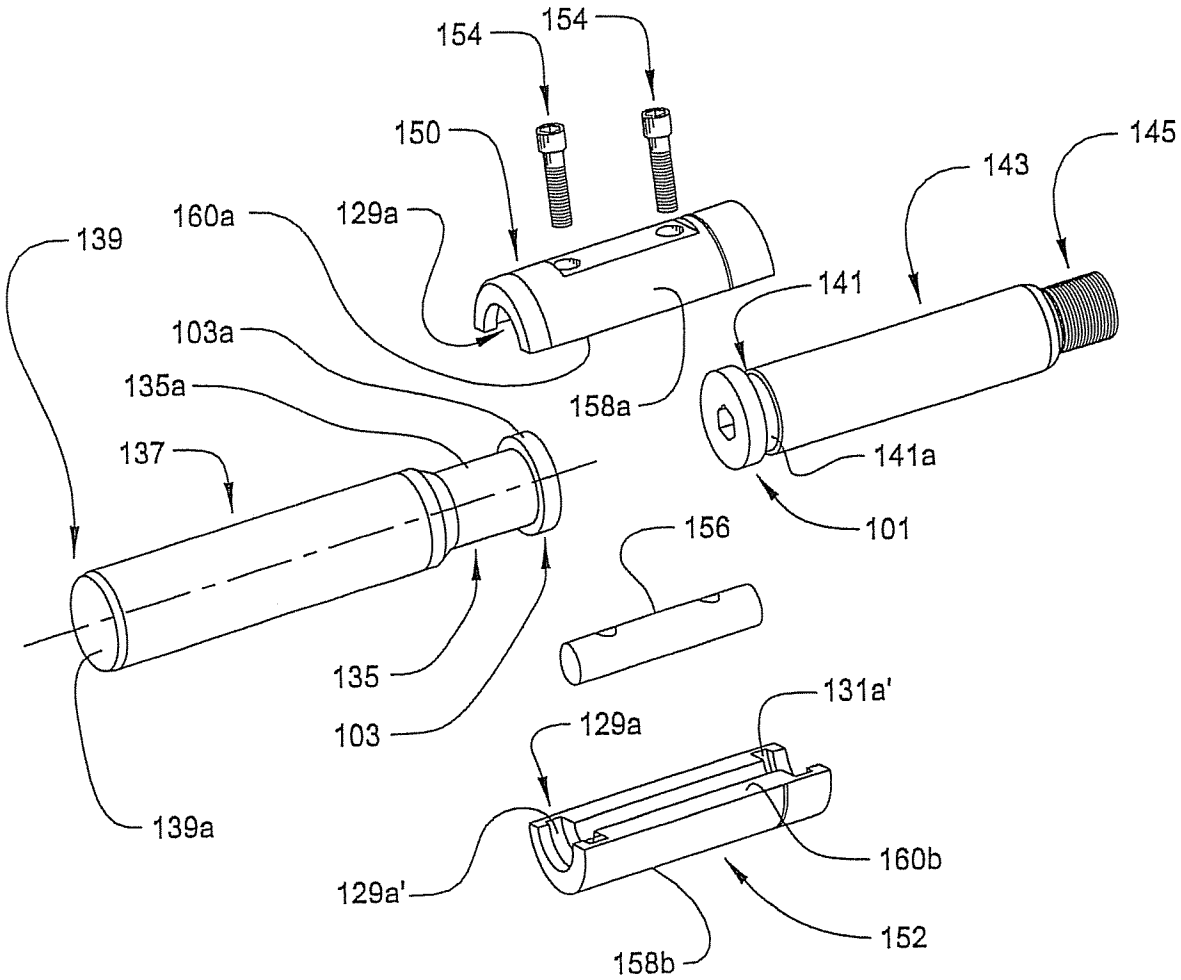
FIG. 7*c* is an exploded view of the assembly shown in FIG. 6.
Figure 8:
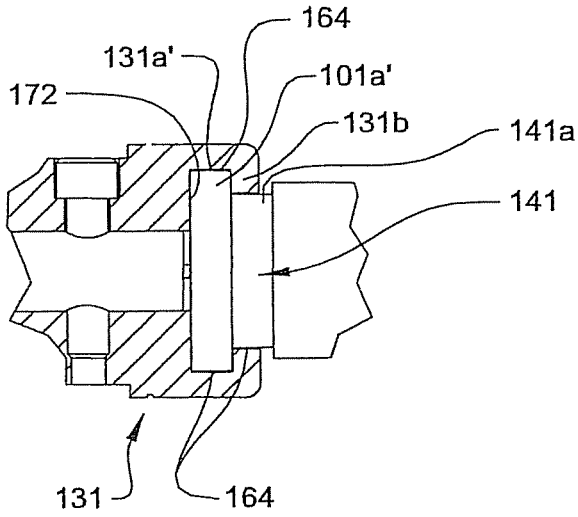
FIG. 8 is a blown-up view of detail A of FIG. 6.
Figure 9:
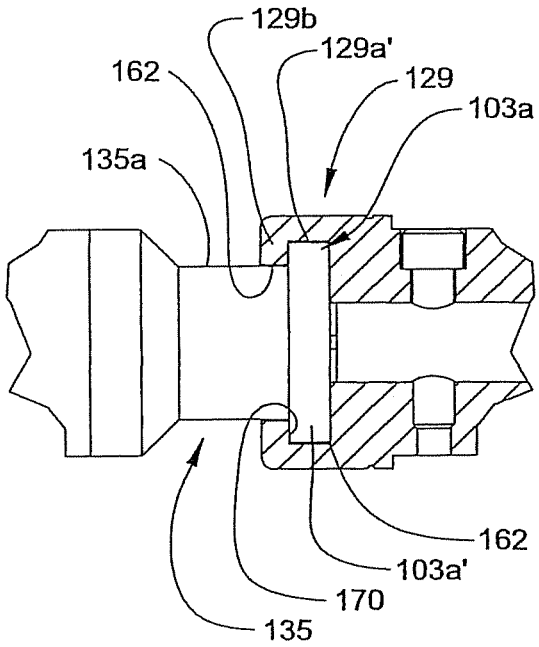
FIG. 9 is a blown-up view of detail B of FIG. 6.
Figure 10:
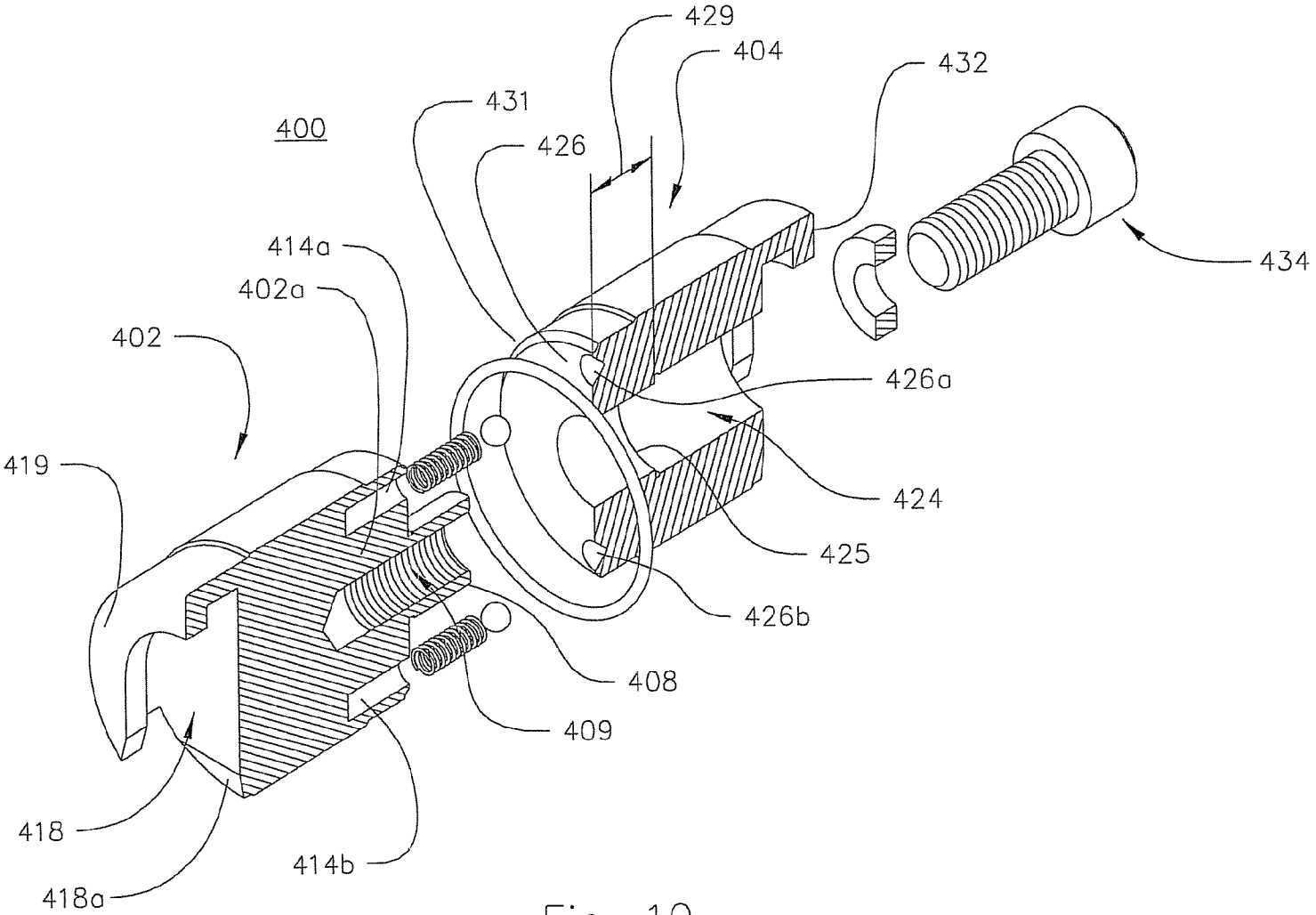
FIG. 10 is an exploded isometric view of an alternative embodiment of a coupling embodying features of my invention.
Figure 11:
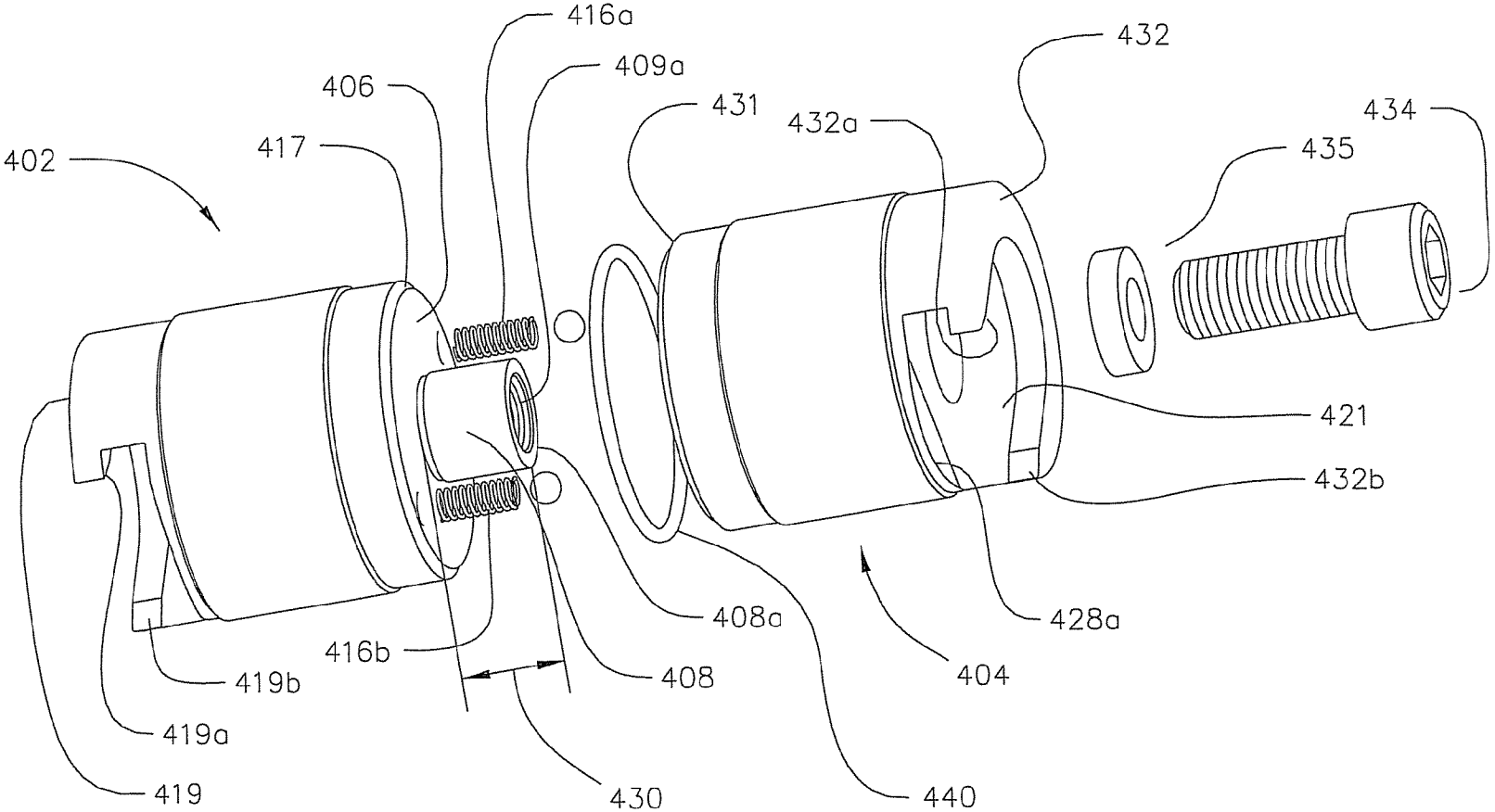
FIG. 11 is an exploded sectional view of the coupling shown in FIG. 10.
Figure 12:
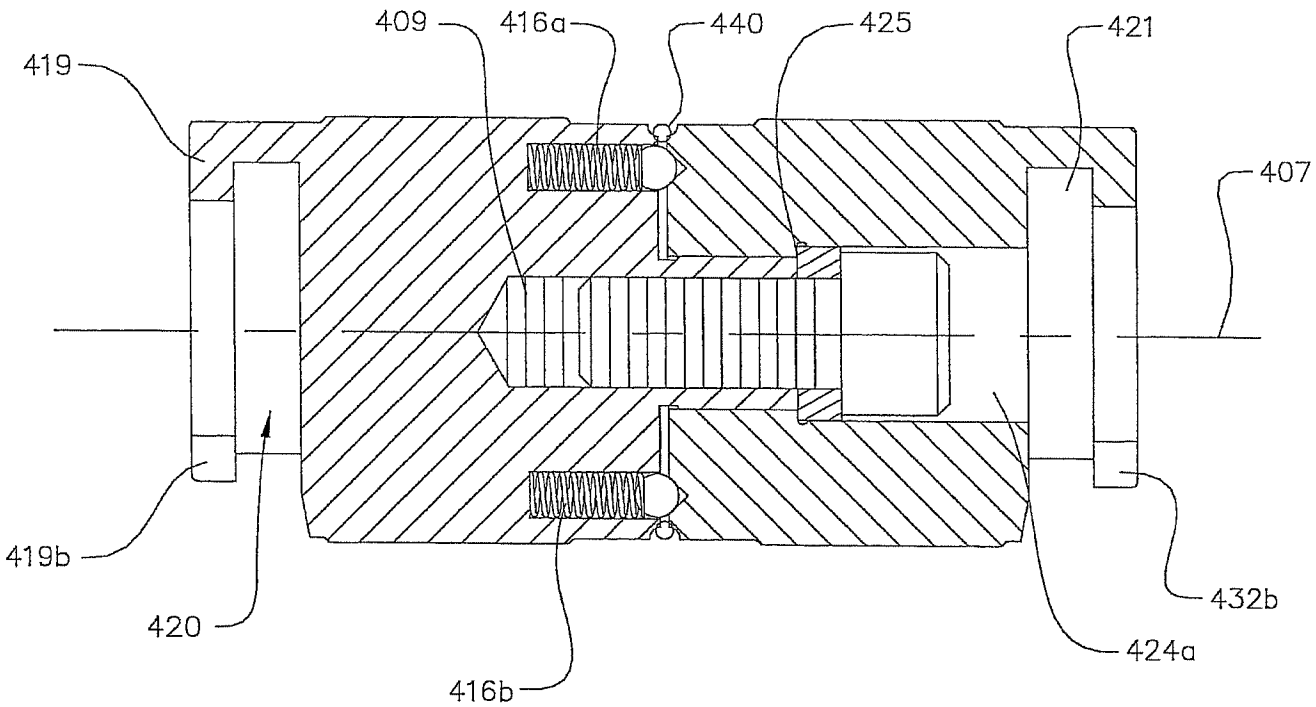
FIG. 12 is a sectional view of the coupling shown in FIG. 11 wherein the coupling is assembled and in an installation orientation.
Figure 13:
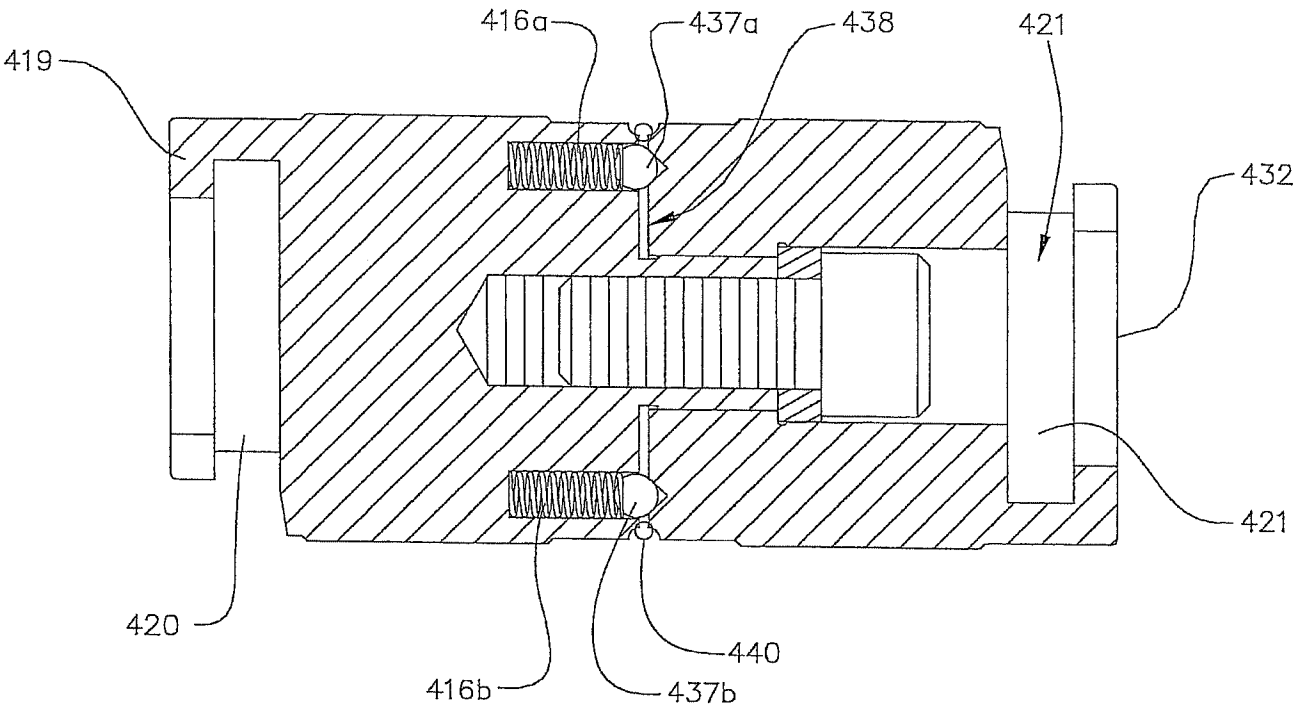
FIG. 13 is a sectional view similar to the view shown in FIG. 12 except the coupling is in a locked position.
Figure 14:
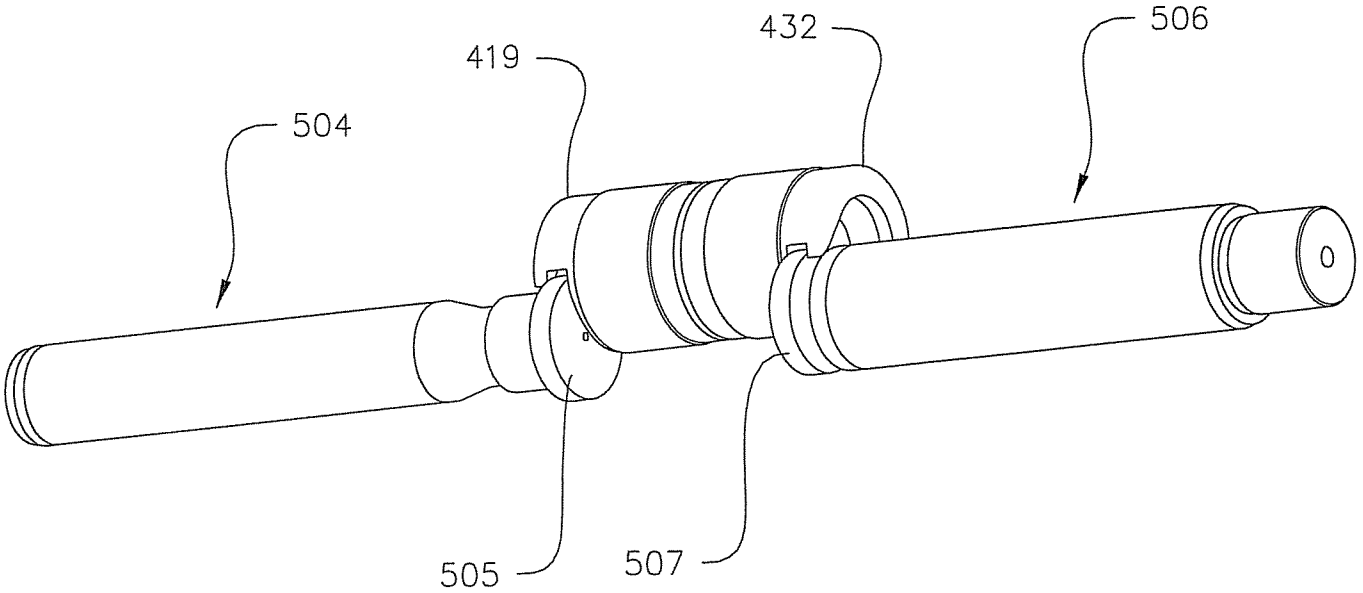
FIG. 14 is a perspective view of the coupling shown in FIG. 12 in the installation position being disposed to couple a plunger to a plunger adaptor.

An example of a pump assembly embodying the present invention includes a pump frame. The frame defines a well. The well has an open end. A stuffing box is engaged with the frame. The stuffing box has an opening. A plunger having a first end with an end surface and a second end with an end surface is linearly movable in the well. The plunger is movable between a first position, wherein the plunger is at the beginning of a discharge stroke, and a second position, wherein the plunger is at an end of a discharge stroke.

The assembly further includes a plunger adaptor. The plunger adaptor has a first end with an end surface and a second end. The plunger adaptor is linearly movable in the well. The plunger adaptor is movable between a first position, wherein the plunger adaptor is at a beginning of said discharge stroke and a second position, wherein said plunger adaptor is at an end of said discharge stroke.

A space is between the plunger and the plunger adaptor. The space has a longitudinal length. The longitudinal length can be measured along a longitudinal axis of the plunger.

The assembly also includes an orientation selectable from a group of orientations. One selectable orientation is an assembled orientation wherein a coupling connects the plunger to the plunger adaptor, and the coupling spans the longitudinal length. Another orientation is a partially disassembled orientation wherein said plunger and plunger adaptor are not connected by the coupling, but in all other respects the assembly is the same.

The longitudinal length of the space is at least great enough to enable movement of the end surface of the second plunger end out of the stuffing box and into the well and out of the well open end, when the pump assembly is in the partially disassembled orientation, and when the plunger adaptor first end is in the well.

In the above example, when the pump assembly is in the assembled orientation, the coupling has a first section removably coupled to a second section. Also in this example the coupling has a first end with a recess, and the plunger first end is in the recess. The coupling has a second end with a recess, and the plunger adaptor first end is in the recess. Further a spacer is between the coupler first section and the coupler second section. The spacer prevents the first section from abutting up against the second section. There is a clearance between the surfaces defining the coupler recesses and the surfaces defining the plunger first end and plunger adaptor first end. The surfaces overlap. The coupling first end is clamped to the first plunger end. The coupling second end is clamped to the plunger adaptor first end.

An example of a coupling embodying the present invention is a coupling having a first end and a second end with a longitudinal length between the first end and the second end. The longitudinal length is at least a longitudinal length of a space between a plunger and plunger adaptor of a pump when said coupling connects the plunger to the adaptor. The longitudinal length is at least great enough to enable removal of an end surface of the plunger out of a stuffing box of the pump and into a well defined by the pump and out of the well through a well open end when the plunger and plunger adaptor are not coupled by the coupling and when the plunger adaptor has a first end within the well.

An example of a method for partially disassembling a pump embodying the present invention is a method which includes disconnecting a plunger from a plunger adaptor and sliding the plunger in a direction away from a fluid end of the pump and towards a power end of the pump and into a well defined by the pump. The plunger is next removed from an open end of the well without disconnecting a power end assembly from a frame of said pump.

DETAILED DESCRIPTION

The below discussion and attached drawings disclose examples of an embodiment encompassing the invention. Other embodiments of the invention are contemplated and the appended claims are intended to cover such other embodiments as are within the scope and spirit of the invention.

FIGS. 2-9 illustrate and describe a pump embodying the present invention. The pump has a coupling 100 which connects plunger adaptor 102 to plunger 104. The coupling 100 provides, maintains, and allows for a space 106 between a first end 103 of plunger 104 and a first end 101 of plunger adaptor 102 during operation of the pump.

The space 106 facilitates disassembly of plunger 104 from the pump. The space allows for an operator or servicer or other person upon only disconnecting the coupling 100 from the plunger 104 and from the plunger adaptor 102 to remove, via the well 114, the plunger 104 from the rest of the pump assembly. From the well, the operator slides the plunger 104 in a direction 108 away from fluid end assembly 110 towards power end assembly 112. (See FIG. 5) The plunger 104 is slid into well 114 defined by the pump frame 116 and removed from the well 114 through open end 118 of well 114. The well 114 and well open end 118 are large enough for a servicer to directly access the coupling 100 with an average size adult hand. Opposite the open end 118 is a well floor 118*a*. Thus, the plunger 104 can be removed from the rest of the pump with minimal disassembly and returned to the pump with minimal reassembly. The arrangement allows for replacement of the components in stuffing box 125, plunger 104, and plunger adaptor 102 with minimal effort. The components replaced within stuffing box 125 can include bushings 120, spring 122 and packing 123.

The plunger first end 103 forms a flange 103*a* of plunger 104. The flange is circumferential and has a radius greater than the radius of a portion of the plunger immediately adjacent the flange 103*a*. The portion with the smaller radius forms a radially inward surface 135*a* of a recess 135. The recess 135 and flange 103*a* form a plunger first section. Adjacent the recess, opposite the flange, is a second plunger section 137 with a radius greater than the radius of the radially inward surface 135*a*. Plunger second section has an end which has an end surface 139*a*. The end surface forms a plunger second 139.

The plunger adaptor first end 101 forms a flange 101*a* of plunger adaptor 102. The flange is circumferential and has a radius greater than the radius of a portion of the plunger adaptor immediately adjacent plunger adaptor flange 101*a*. The portion with the smaller radius forms a radially inward surface 141*a* of a recess 141. The recess 141 and flange 101*a* form a plunger adapter first section. Adjacent the recess, opposite the flange, is second plunger adaptor section 143 with a radius greater than the radius of the radially inward surface 141*a*. The plunger adaptor second section has an end which forms a plunger adaptor second end 145.

The coupling has a first end 129 which has a first recess 129*a*. The recess is circumferential. The coupling has a second end 131 which has a second recess 131*a*. The recess is circumferential.

Coupling 100 when coupled to plunger 104 and plunger adaptor 102 has a particular arrangement. Coupling 100 spans at least the longitudinal length 107 of space 106. The length 107 can be measured along longitudinal axis 127 of coupling 100. Coupling 100, at first end 129 is coupled to plunger first end 103. Coupling 100 at second end 131 is coupled to plunger adaptor first end 101. Plunger flange 103*a* is in coupler first recess 129*a* and clamped at coupling first end 129. Plunger adaptor flange 101*a* is in coupler second recess 131*a* and clamped at coupling second end 131. A portion 131*b* of coupling second end 131 is in plunger adaptor recess 141. A portion 129*b* of coupling first end 129 is in plunger recess 135.

In more detail the coupling has a first section 150 removably coupled to a second section 152. The sections are coupled by hex-head screws 154. A pin or spacer 156, between the first 150 and second 152 sections, separates the sections' along their longitudinal lengths. The screws extend through aperatures of the first coupling section, through the pin separating the first and second sections and into the second coupling section. Each coupling section forms a half of coupling 100. Each half has an arcuate surface 158*a*, 158*b* and an opposite flat surface 160*a*, 160*b*. Pin or spacer has a diameter sufficient to prevent the flat surfaces 160*a*, 160*b* along their longitudinal lengths from abutting each other. Thus the sections 150, 152 do not abut each other.

The clearance 300 between the sections 150, 152 and in particular flat surfaces 160*a*, 160*b* provides a clearance 162 between a surface 129*á* defining coupling first recess 129*a* and a surface 103*á* defining plunger flange 103*a*. The clearance between flat surfaces 160*a*, 160*b* also provides a clearance 164 between a surface 131*á* defining coupling second recess 131*a* and a surface 101*á* defining adaptor flange 101*a*. Each of the recess defining surfaces 129*á*, 131*á* form a radially recessed surface which is circumferential. Each of the flange defining surfaces 101*á*, 103*á* form a radial surface which is circumferential. The clearances 162, 164 between the flange surfaces *á*, 103*á* and coupling recess defining surfaces of 129*á*, 131*á* are radial clearances. The clearances extend in the radial direction and span the entire overlap between surfaces 101*á*, 103*á* and surfaces 129*á*, 131*á*.

Clearance 162 is also provided between portion 129*b* of coupling first end 129 and surface 135*a* of recess 135. The clearance is also radial and spans the entire overlap of surfaces. Clearance 164 is also provided between portion 131*b* of coupling second end 131 and surface 141*a* of recess 141. The clearance is also radial and spans the entire overlap of surfaces.

The clearances allow for plunger first end 103, adaptor first end 101, and coupler 100 to shift relative to each other to help accommodate any misalignment between plunger 104, plunger adaptor 102, and coupler 100 along their axis.

As can be seen, the longitudinal length 107 extends a distance, herein referred to as "X", between an end surface 166 at plunger first end 103 and an end surface 168 of plunger adaptor first end 101 when coupler 100 connects plunger 104 to plunger adaptor 102. The distance X is about the axial distance between an end wall 170 at first coupler end 129 and an end wall 172 at second coupler end 131. The distance "X" is equal to or greater than the length of plunger 104 measured along the plunger's longitudinal axis, less the stroke length 171 of the pump. The distance "X" should be at least a length, measured in the axial and longitudinal direction 140, sufficient to enable a servicer, from the well, to move end surface 139*a* of plunger second end 139 in the axial direction 140 out of stuffing box 125, and through and out of pump frame opening 174 and into well 114, when the plunger is at the beginning of its discharge stroke, and the coupling is removed from the plunger 104 and adaptor 102.

To remove the plunger, a servicer would adjust the pump so that the plunger is at the beginning of its discharge stroke. (See FIG. 5) The servicer would remove coupling 106 and gland nut 176 from stuffing box 125. The plunger 104 would then be pulled out from well 114 without disassembling the suction manifold 178, discharge manifold 180, fluid cylinder block 182, suction valve assembly 184, discharge valve assembly 186, or bolts 188 from the rest of the pump. Also the servicer does not have to remove plunger adaptor 102 from cross head 190. The power end assembly 112 can remain coupled to the frame 116. The plunger adaptor first end 101 may remain in the well. The power end assembly includes connecting rod 194 and crank shaft 196, and cross head 190.

When coupling 100 is connected to plunger 104 and plunger adaptor 102 and in well 114, the pump assembly is in an orientation which can be considered an assembled orientation. When coupling 100 is not connected to plunger 104 and plunger adaptor 102 but plunger adaptor first end and plunger first end are still in well 114, the pump assembly is in an orientation which can be considered a partially disassembled orientation. In the partially disassembled orientation the plunger and plunger adaptor are not connected. In all other respects the assembly is the same. The servicer may select the orientation.

To properly space the plunger 104 and plunger adaptor 102 for installation of coupling 100, a gauge can be used.

The fluid end assembly 110 includes suction manifold 178, discharge manifold 180, fluid cylinder block 182, suction valve assembly 184, and discharge valve assembly 186. Notably removal of plunger 104 does not require disassembly of the fluid end assembly or uncoupling the fluid end assembly from frame 116.

Figure 15:
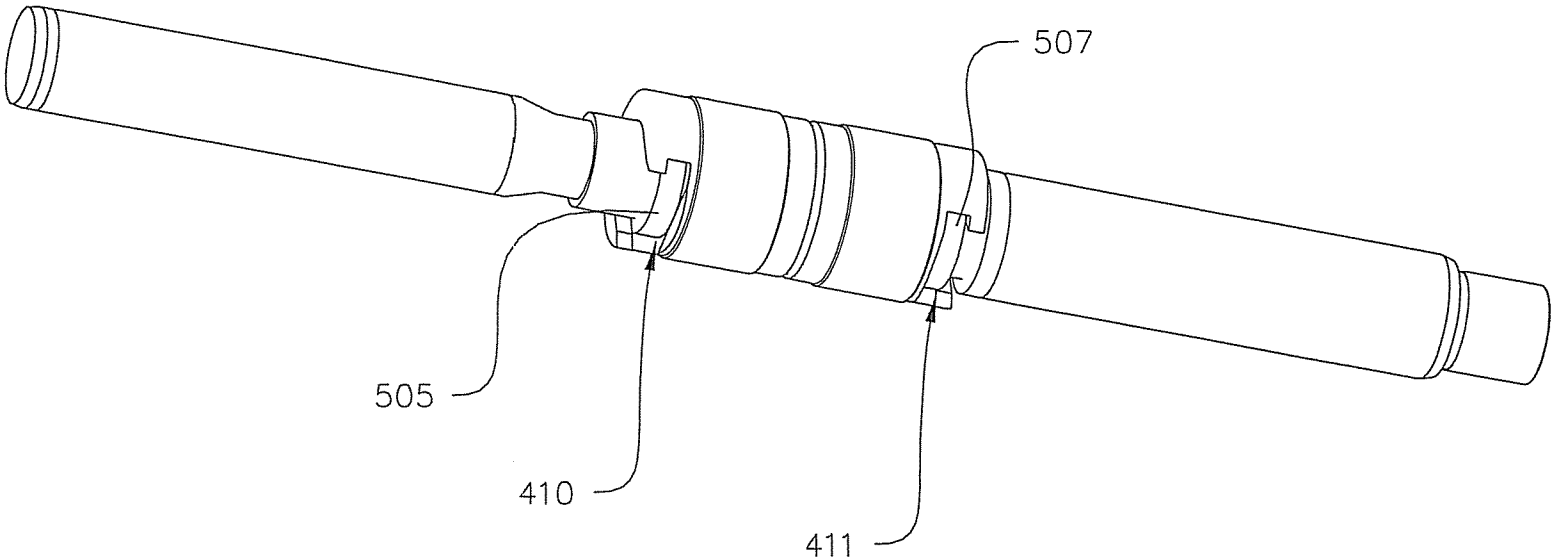
FIG. 15 is a prospective view of the coupling, plunger and plunger adaptor shown in FIG. 14 wherein the adaptor has been coupled to the plunger and plunger adaptor; and the coupling is about to be adjusted to the locked position.
Figure 16:
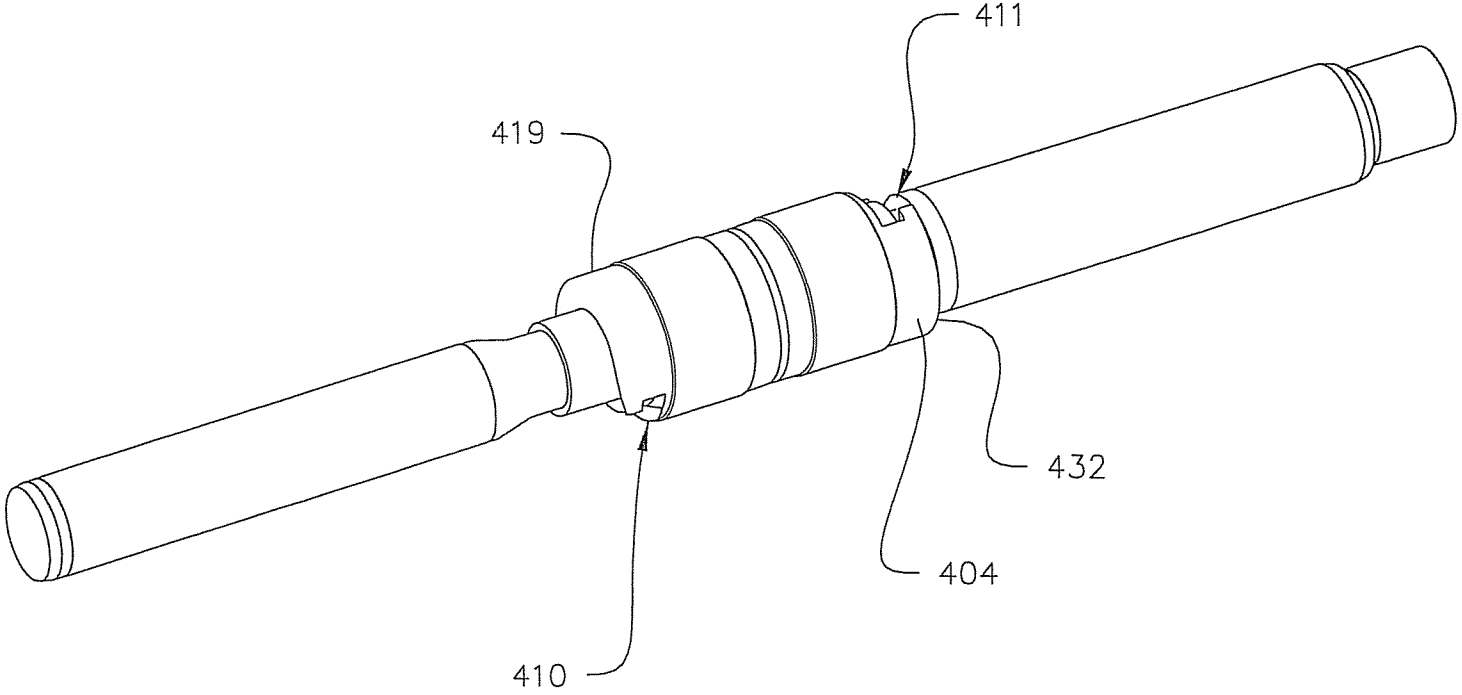
FIG. 16 is a perspective view of the coupling shown in FIG. 15 wherein the coupling is in the locked position; a portion of the coupling has been rotated 180° in the direction of the arrow shown in FIG. 15 until a snap sound signals the coupler is in the locked position.

FIGS. 10-16 show an alternative coupling 400. Coupling 400 has a first body 402 coupled to a second body 404. Coupling 400 connects plunger 504 to plunger adaptor 506. The first body 402 has recess 420 into which plunger flange 505 is received. The second body 404 has a recess 421 into which plunger adaptor flange 507 is received. See FIGS. 14 and 15. In the orientation shown in FIGS. 14 and 15 the coupling 400 is in an installation orientation. The coupling bodies 402 and 404 are adjusted from the installation orientation to a locked orientation by rotating coupling body 404 or 402 180°. See FIGS. 15 and 16 showing rotation of the coupling body 404 180° to adjust coupling 400 from the installation orientation to the locked orientation. In the locked position openings 410, 411 face in opposite directions. Plunger 504 and plunger adaptor 506 are shown in a floating orientation for illustrative proposes only. In connection with the discussion herein plunger 504 and plunger adaptor 506 are to be considered carried in the fluid end assembly 110 and power end assembly 112 like plunger 104 and plunger adaptor 102. The assemblies 110 and 112 keep the plunger 504 and plunger adaptor 506 radially constrained and thus prevent them from sliding out of openings 410 and 411 when coupling 400 is in the locked position. If they were floating as illustrated they of course could be uncoupled from coupling 400 even when coupling 400 is in the locked position. They would simply be slid out of openings 410 and 411.

In more detail, first body 402 has a first face surface 406 extending radially from coupling axis 407 and parallel to axis 407. Insert member 408 extends axially away from first surface 406. An aperature 409 extends through insert 408 and into a central region 402*a* of first body 402. The aperature has threads 409*a*. The first surface 406 has additional aperatures 414*a*, 414*b* which carry springs 416*a* and 416*b*. The aperatures 414*a*, 414*b* are spaced 180° apart. A groove 417 rims first face surface 406.

Body 402 has a second face surface 418 axially opposite and facing away from said first face surface 406. The second surface extends radially from axis 407. An arcuate extension 419 rims a portion of said first body second face surface 418. Extension 419 and said second surface 418 form a recess 420. Extension 419 has radially outward angled ends 419*a*, 419*b*. The ends are angled in a radial direction away from coupling axis 407. The ends bound a flange receiving opening 410 which opens into recess 420. Second face surface 418 has an axially angled section 418*a*. The section slants towards said first face surface 406 and is unbounded by said extension 419. The angled section 418*a* and angled ends 419*a*, 419*b* facilitate insertion of plunger flange 505 into recess 420.

The second body 404 has a through hole 424 extending therethough and opening through second body first face surface 426 and second face surface 428. The first face surface and second face surface extend radially away from axis 407. The first face surface has detents 426*a*, 426*b* 180° apart. Through hole 424 has a stepped portion 425. An axial length 429 extends from second body first surface 426 to said stepped portion 425. The axial length is less than the axial length 430 of said insert 408. A groove 431 rims first surface 426.

An arcuate extension 432 extends away from the second surface 428. The extension has ends 432*a*, 432*b* which are angled in the radial direction away from axis 407. The ends bound a flange receiving opening 411 which opens into recess 421. The extension rims a portion of said face surface 428 and together with said second face surface 428 forms recess 421.

The second face surface 428 has a portion unbounded by said extension. A portion 428*a* of the unbounded portion is angled in the axial direction towards the second body first face surface 426.

In an assembled orientation, coupling body 402 is coupled to body 404. First body insert member 408 is disposed within through hole 424. A threaded bolt 434 extends through second body second surface 428, into through hole 424, through insert 408 and into central region 402*a*. Washer 435, adjacent the bolt head, abuts against stepped portion 425. Abutment of washer 435 up against step portion 425 and an end wall 408*a* of insert 408 pushes first body first surface 406 away from the second body first surface a distance. The distance is equal to the difference between insert axial length 430 and step axial length 429. The bolt head could be used for the abutment.

Locator balls 437*a*, 437*b* are between said first body first surface 406 and second body first surface 426. The balls are carried by springs 416*a*, 416*b*.

The first body first face surface 406 and second body first face surface 426 face each other and are separated by a small gap 438. The gap is about the difference between insert axial length 430 and stepped axial length 429.

Groove 417 and groove 431 are adjacent each other and form an o-ring receiving groove. O-ring 440 is disposed in o-ring receiving groove 417, 431. The o-ring keeps grease disposed between gap 438 from escaping and also keeps debris out of gap 438.

The first body 402 and second body 404 are rotatable relative to each other about axis 407. The bodies can rotate 360° about axis 407. The bodies do not move in the axial direction relative to each other. To prevent bolt 434 from unscrewing a, glue may be applied to aperature 409 during assembly. Also portion 424*a* may be filed.

To make sure gap 38 is the proper axial length, after assembly of the first body to the second body, a gauge can be used.

The bodies can be rotated relative to each other so that coupling 400 is in an installation and removable position. See FIGS. 12 and 15. In the installation position detents 426*a*, 426*b* are aligned with aperatures 414*a*, 414*b*. Locator balls 437*a*, 437*b*, carried by springs 416*a*, 416*b* are in detents 426*a*, 426*b*. Flange receiving openings 410 and 411 are facing in the same direction with the same angular orientation relative to axis 407. When coupling 400 is in the installation or removable position, coupling 400 connects plunger 504 to plunger adaptor 506. To install the coupler when oriented in the installation position, the plunger flange 505 is slid, through flange opening 410, into first body recess 420. The plunger adaptor flange 507 is slid, through flange opening 411, into the second body recess 421. See FIGS. 14 and 15.

Once installed coupling 400 can be adjusted to a locked position or orientation. See FIGS. 15 and 16. To adjust coupling 400 to the locked position, one of the coupling bodies 402, 404 are rotated 180° relative to the other coupling bodies. The coupling bodies by virtue of the locator balls 437*a*, 437*b* will emit a snapping sound when one of the bodies is rotated 180° relative to the other body. The snapping sound is caused by the locator ball again falling within detents 426*a*, 426*b*. Accordingly in the locked position, aperatures 414*a*, 414*b*, detents 426*a*, 426*b* and locator balls 437*a*, 437*b* are all aligned. Also flange receiving openings 410 and 411 face opposite directions with a 180° opposite angular orientation.

From the locked position the coupling can be adjusted again to the insert/removable position by rotating one of the bodies 402, 404 180° relative to the other.

The coupling 400 provides for an easy coupling and uncoupling of plunger adaptor 506 and plunger 504. Once coupling 400 is uncoupled from the plunger and plunger adaptor, the plunger 504 can be removed from its associated pump in the same manner as plunger 104.

The invention claimed is:

1. A coupling of a pump connecting a plunger and a plunger adaptor, the coupling comprising:

a first body having a first recess into which a plunger flange of the plunger is received; and a second body coupled to the first body, the second body having a second recess into which a plunger adaptor flange of the plunger adaptor is received;

wherein, in an installation orientation, the first recess and the second recess face in a first direction with a first angular orientation relative to a coupling axis, wherein, in a locked orientation, the first recess faces in the first direction with the first angular orientation relative to the coupling axis, and the second recess faces in a second direction with a second angular orientation relative to the coupling axis, the first angular orientation is 180° opposite the second angular orientation, and wherein the first body and the second body are adjusted 180° relative to one another to move from the installation orientation to the locked orientation, and wherein said plunger flange is in said first body recess and said adaptor flange is in said second body recess when said first body and second body are in said installation orientation and in said locked orientation.

2. The coupling of claim 1 wherein the first body includes a first face surface extending radially from the coupling axis and perpendicular to the coupling axis;

an insert member extending axially away from the first face surface; and a first aperture extending through the insert member into a central region of the first body.

3. The coupling of claim 2 wherein the first aperture includes threading disposed on an interior surface thereof.

4. The coupling of claim 1 further comprising at least second and third apertures disposed on the first face surface of the first body and spaced 180° degrees apart, the second and third apertures carrying respective first and second springs.

5. The coupling of claim 1 further comprising a groove rimming the first face surface of the first body.

6. The coupling of claim 1 further comprising a second face surface axially opposite and facing away from the first face surface, wherein the second face surface extends radially from the coupling axis.

7. The coupling of claim 6 wherein the second face surface of the first body includes an arcuate extension rimming at least a portion of the second face surface to form the first recess.

8. The coupling of claim 7 wherein the arcuate extension includes at least first and second radially outward angled ends angled in a radial direction away from the coupling axis and bounding the first recess.

9. The coupling of claim 6 wherein the second face surface of the first body includes an axially angled section slanting towards the first face surface of the first body.

10. The coupling of claim 1 wherein the second body includes an aperture extending therethrough, the aperture opening through a first face surface of the second body and a second face surface of the second body.

11. The coupling of claim 10 wherein the first face surface of the second body includes at least first and second detents spaced 180° degrees apart.

12. The coupling of claim 10 wherein the aperture extending through the second body includes a stepped portion, and an axial length extending from the first face surface of the second body to the stepped portion, wherein the axial length is less than an axial length of the insert member of the first body.

13. The coupling of claim 10 further comprising a groove rimming the first face surface of the second body.

14. The coupling of claim 10 wherein the second face surface of the second body includes an arcuate extension extending away from at least a portion of the second face surface of the second body to form the second recess.

15. The coupling of claim 14 wherein the arcuate extension includes at least first and second radially outward angled ends angled in a radial direction away from the coupling axis and bounding the second recess.

16. The coupling of claim 15 wherein the second face surface of the second body includes an axially angled section slanting towards the first face surface of the second body.

17. A coupling of a pump connecting a plunger and a plunger adaptor, the coupling comprising:

a first body having a first recess into which a plunger flange of the plunger is received, the first body including a first face surface axially opposite and facing away from a second face surface, and an insert member extending axially away from the first face surface of the first body; and a second body having a second recess into which a plunger adaptor flange of the plunger adaptor is received, the second body including a first face surface axially opposite and facing away from a second face surface, and a first aperture extending from the first face surface of the second body, through the second body to the second face surface of the second body;

wherein the insert member of the first body is disposed within the first aperture of the second body to couple the first body to the second body, wherein, when coupled together, the first body is separated from the second body by a first distance, wherein, in an installation orientation, the first recess and the second recess face in a first direction with a first angular orientation relative to a coupling axis, wherein, in a locked orientation, the first recess faces in the first direction with the first angular orientation relative to the coupling axis, and the second recess faces in a second direction with a second angular orientation relative to the coupling axis, the first angular orientation is 180° opposite the second angular orientation, and wherein the first body and the second body are adjusted 180° relative to one another to move from the installation orientation to the locked orientation, and wherein said plunger flange is in said first body recess and said adaptor flange is in said second body recess when said first body and second body are in said installation orientation and in said locked orientation.

18. The coupling of claim 17 further comprising a threaded bolt extending through the second face surface of the second body into the first aperture of the second body and through the insert member of the first body.

19. The coupling of claim 18 further comprising a washer adjacent a head of the threaded bolt, wherein the washer abuts against a stepped portion of the first aperture of the second body.

20. The coupling of claim 17 further comprising at least first and second locator balls disposed between the first body and the second body.

21. The coupling of claim 20 wherein the first and second locator balls are carried by springs.

22. The coupling of claim 17 further comprising an O-ring disposed between the first body and the second body.

23. An assembly in a pump, said assembly comprising:

a frame, said frame defining a well, said well having an open end;

a plunger, said plunger having a first end with an end surface, said plunger having a second end with an end surface, said plunger linearly movable for a stroke length between a first position, wherein said plunger is at the beginning of a discharge stroke, and a second position, wherein said plunger is at an end of a discharge stroke, said plunger accessible from said well;

a plunger adaptor, said plunger adaptor having a first end with an end surface and a second end, said plunger adaptor linearly movable between a first position, wherein said plunger adaptor is at a beginning of said discharge stroke and a second position, wherein said plunger is at an end of said discharge stroke, said plunger adaptor accessible from said well; and a space is between said plunger and said plunger adaptor; said space having a longitudinal length, said longitudinal length is measured along a longitudinal axis of the plunger;

an orientation selected from a group of orientations consisting of an assembled orientation wherein a coupling connects said plunger to said adaptor, and said coupling spans the longitudinal length; and a partially disassembled orientation wherein said plunger and plunger adaptor are not connected;

and wherein said longitudinal length of said space is at least great enough when said plunger is in said first position to enable removal of said second plunger end out of said well open end, when said pump assembly is in said partially disassembled orientation, and when said plunger adaptor first end is in said well.

24. The assembly of claim 23 wherein said coupling comprises:

a first body having a first face surface axially spaced from a second face surface;

an extension rims a portion of said first body second face surface;

a recess formed by said extension and said second face surface;

a second body having a first face surface and a second face surface;

an extension rims a portion of said second body second face surface;

a recess formed by said extension which rims said second body second face surface and said second body second face surface;

a longitudinal length between said second face surfaces;

a locator assembly forming a portion of said coupling;

wherein said first body is rotatably coupled to said second body, said first face surface of said first body faces said first face surface of said second body, said first face surfaces are rotatable relative to each about an axis of said coupling between a first position and a second position, said locator assembly signaling when said face surfaces are rotated from said first position to said second position; and wherein said second position is a position which locks the coupling to the plunger and plunger adaptor when said assembly is in the assembled orientation and said first position is a position which allows removal of the coupling from the plunger and plunger adaptor when said assembly is in the assembled orientation, and when said assembly is in said assembled orientation and said coupling is rotated to be in said first position and rotated to be in said second position a flange at said plunger first end is in said recess formed by said extension and said second face surface of said first body and a flange at said adaptor first end is in said recess formed by said extension and second face surface of said second body.

* * * * *